US011591200B2

(12) United States Patent
Robles

(10) Patent No.: US 11,591,200 B2
(45) Date of Patent: Feb. 28, 2023

(54) PACKAGE OPENER, DISPENSER, AND RELATED METHODS

(71) Applicant: Christopher Robles, Chula Vista, CA (US)

(72) Inventor: Christopher Robles, Chula Vista, CA (US)

( * ) Notice: Subject to any disclaimer, the term of this patent is extended or adjusted under 35 U.S.C. 154(b) by 0 days.

(21) Appl. No.: 17/020,306

(22) Filed: Sep. 14, 2020

(65) Prior Publication Data

US 2022/0081274 A1 Mar. 17, 2022

(51) Int. Cl.
*B67B 7/86* (2006.01)

(52) U.S. Cl.
CPC ..... *B67B 7/28* (2013.01)

(58) Field of Classification Search
CPC .... B67B 7/24; B67B 7/26; B67B 7/28; B65D 25/40; B65D 25/42; B65D 25/46; B65D 75/5872; B65D 75/5877; B65D 75/5861; B65D 75/70; B65D 75/5866; B67D 7/06
See application file for complete search history.

(56) References Cited

U.S. PATENT DOCUMENTS 979,072 A * 12/1910 Javins ..... B67B 7/28 222/83.5
1,863,853 A * 6/1932 Jackson ..... B67B 7/28 222/83.5
1,920,385 A * 8/1933 Hamilton ..... B67B 7/28 222/83.5
1,948,997 A * 2/1934 Vaverek ..... B67B 7/28 222/83.5
2,013,328 A * 9/1935 Wiswell ..... B67B 7/28 222/536
2,056,530 A * 10/1936 Miller ..... B67B 7/28 222/83
2,129,971 A * 9/1938 Fredericks ..... B67B 7/28 222/83.5
2,568,612 A 9/1951 Cullen
3,418,059 A 12/1968 Robe
4,053,979 A 10/1977 Tuthill
4,562,940 A * 1/1986 Asphar ..... B65D 83/06 222/88
4,722,850 A * 2/1988 White ..... A61J 9/005 206/499
4,776,488 A * 10/1988 Gurzan ..... B65D 75/5872 222/81
4,946,040 A * 8/1990 Ipenburg ..... B65D 75/5872 215/11.3
4,974,744 A * 12/1990 Shanklin ..... A47G 23/0258 220/254.1
5,007,171 A 4/1991 Horning
5,101,562 A 4/1992 Horvath
5,150,811 A * 9/1992 Kelston ..... A47G 23/0258 222/93
5,357,679 A 10/1994 Hanna
(Continued)

*Primary Examiner* — Donnell A Long
(74) *Attorney, Agent, or Firm* — Buche & Associates, P.C.; John K. Buche; Bryce A. Johnson

(57) ABSTRACT

A tool for opening and dispensing soft package contents which has two arms, a hinge connecting the arms, and a hollow prick. A soft package is placed between the two arms so the soft package contents can be opened and dispensed in an easy and sanitary manner through the hollow prick, after which the arms can be opened, and the soft package easily disposed.

7 Claims, 10 Drawing Sheets

(56) References Cited

U.S. PATENT DOCUMENTS

| | | | | |
|---|---|---|---|---|
| 5,752,319 | A | 5/1998 | Su | |
| 5,857,593 | A | 1/1999 | Patronaggio | |
| 6,263,772 | B1 | 7/2001 | Navot | |
| 6,659,994 | B1 * | 12/2003 | Mader | A61J 1/2089 220/277 |
| 7,073,264 | B2 | 7/2006 | Votolato | |
| 7,730,620 | B1 | 6/2010 | Anastasi | |
| 8,528,783 | B2 * | 9/2013 | Pritchard | B65D 75/5877 222/83 |
| 8,887,957 | B2 | 11/2014 | Robinson | |
| 9,090,445 | B2 * | 7/2015 | Py | B67D 3/043 |
| 9,221,664 | B2 | 12/2015 | Votolato | |
| D747,169 | S | 1/2016 | Koresh | |
| 10,099,395 | B2 | 10/2018 | Ferreira | |
| 10,377,619 | B2 | 8/2019 | Votolato | |
| 2006/0156553 | A1 | 7/2006 | Alvarez | |
| 2010/0038380 | A1 * | 2/2010 | Compton | B65D 75/5877 222/105 |
| 2010/0083794 | A1 | 4/2010 | Galpin | |
| 2012/0241466 | A1 * | 9/2012 | Genosar | A61M 5/282 222/1 |
| 2013/0292414 | A1 * | 11/2013 | Sutherland | A47K 5/1201 222/107 |
| 2020/0140154 | A1 * | 5/2020 | Taylor | B65D 47/103 |
| 2020/0255201 | A1 * | 8/2020 | Blysniuk | B65D 75/66 |

* cited by examiner

PACKAGE OPENER, DISPENSER, AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of tools for opening and dispensing contents of soft packages.

Background of the Invention

Food safety is a scientific practice of storing, handling, and preparing food in ways that mitigate risks of food borne illness. As food moves from farm or factory to table certain food safety practices and methods are implemented at each step to ensure food safety. These methods and practices may be related to food labeling, hygiene, additives, and pesticides residues.

Contaminated food is unsafe because it can transmit disease causing and potentially deadly pathogens. The pathogens which pose threats to people are generally bacteria, viruses, mold, or fungus. Improperly handled food may both introduce and incubate pathogens. Once pathogens have been introduced to the food, the food is said to be contaminated. Physical interaction with food may introduce physical contaminants such as hair, plants, particulates, pieces of plastic, and pieces of metal. These objects pose both a physical and bacterial threat to whoever may eat the contaminated food.

Since food safety is such an important consideration for people everywhere, health organizations, such as the World Health Organization, create and promote principles for food safety. Five principles related to food safety have been outlined by the World Health Organization: 1) prevent contaminating food with pathogens derived from people, animals, or insects; 2) Separate raw and cooked foods; 3) Cook foods at adequate time and temperature to kill pathogens; 4) Store food at the proper temperature; and, 5) use safe water and safe raw materials when cooking. Although these principles are simple and concise, they are not perfect, as pathogens still find ways into food. However, when implemented correctly the World Health Organization's principles substantially mitigate the instance of food borne illnesses.

Although food safety is highly regulated as food moves from farm to home, food safety in the home is relatively unregulated and guided by practices that may vary widely from house to house or culture to culture. The inconsistencies between home food safety practices is exacerbated by the fact that different foods have different contamination properties. For example, liquid foods kept in a hot slow cooker (65° C.) may last only a few hours before contamination, but fresh meats like beef and lamb that are promptly frozen (−2° C.) can remain uncontaminated for up to a year. Further, some contaminants like bacteria may not be visible, may be impossible to taste, and may be generally undetectable. The problem of a lack of a consistent set of known regulations for food safety in the home is evidenced by a 2003 World Health Organization report which concluded that about 30% of reported food poisoning outbreaks in the WHO European Region occur in private homes. To put this finding into perspective, consider the World Health Organization finding that there are 76 million cases of foodborne illness leading to 325,000 hospitalizations and 5,000 deaths each year in the US alone.

A recent coronavirus pandemic has changed societies perception of sanitation. With a revelation that a coronavirus strain, Covid-19, could survive for days on surfaces and may be passed through respiratory droplets, touching the items of others became a questionable prospect. It has been the consensus, considering the pandemic, that individuals should handle their own items.

The first principle outlined by the World Health Organizations is to prevent contaminating food with pathogens derived from people, animals, and insects. A good way to interpret the principle is to limit the contact that food may have with people who are not eating the food.

Although it is clearly best practice not to handle the food of others, there are situations when we must handle the foods of others. Cooks must handle the food of restaurant patrons as part of their job duties. Some people are partially or completely incapable of handling their food themselves. Specifically, children are not able to open condiment packaging. Often, parents are tasked with opening condiment packaging for their children. Parents handling and opening condiment packaging can be cumbersome and unsanitary considering the current pandemic as well as other instances of food borne illness. Thus, a need exits for a tool that can be used by children to puncture and dispense a condiment from a soft package.

LISTING OF RELATED ART

Related patent documents are incorporated to the disclosure below:

U.S. Pat. No. 7,730,620 to Anastasi discloses a, "Plastic package opener."

U.S. Pat. No. 7,073,264 to Votolato discloses a, "Bag slitting apparatus."

WO2008086101A1 to Pearson discloses a, "Cutting device."

U.S. Ser. No. 10/377,619 to Votolato discloses a, "Bag cutter and piercer."

USD747169 to Koresh discloses a, "Cutting tool for sauce sachets."

U.S. Pat. No. 5,357,679 to Hanna discloses a, "Bag opening device."

U.S. Pat. No. 9,221,664 to Votolato discloses a, "Bag cutter and piercer."

US20060156553A1 to Alvarez discloses a, "Device to facilitate the opening of condiment packages."

U.S. Pat. No. 5,752,319 to Su discloses a, "Cutting means removably attached to polybag to be opened."

U.S. Pat. No. 8,887,957 to Robinson discloses a, "Device for opening and dispensing contents of packets."

WO2013120154A2 to Vanderlei discloses a, "Disposable snap-type sachet-opening device."

GB2469464A to McKensie discloses a, "Device for expelling the contents of a sachet."

U.S. Pat. No. 3,418,059 to Robe discloses a, "Dispense package for flowable materials and method of forming the same."

U.S. Pat. No. 5,857,593 to Patronaggio discloses a, "Collapsible flexible tube squeezing device."

U.S. Pat. No. 6,263,772 to Navot discloses a, "Device for opening packets and for dispensing the contents thereof."

U.S. Pat. No. 5,101,562 to Horvath discloses a, "Squeezer cutter."

U.S. Pat. No. 5,007,171 to Horning discloses a, "Bag opener apparatus."

U.S. Pat. No. 4,053,979 to Tuthill discloses a, "Suture cutter."

U.S. Pat. No. 2,568,612 to Cullen discloses a, "Combination container opener."

US20100083794A1 to Galpin discloses a, "Double-ended tool for opening soft-sided sealed condiment packets and fluid containers having membrane seals."

U.S. Ser. No. 10/099,395 to Ferreira discloses a, "Condiment package opening device."

SUMMARY OF THE INVENTION

In view of the foregoing, an object of this specification is to disclose a tool that can be used by children to puncture and dispense a condiment from a soft package. The tool features a tubular prick that is disposed between two planks that are connected via a hinge. The tool allows a condiment to be dispensed without tearing the package with one's hands and seeks to address problems associated with sanitation and food handling.

Another object of this specification is to disclose a tool which both children and parents are expected to benefit from. The tool may allow children to handle their own food. Allowing children to handle their own food may create a more sanitary eating experience for both children and their parents. Further, parents are no longer saddled with the burden of handling their children's condiments. The tool may be marketed to any establishment that provides packaged condiments and to parents with young children. The tool may be sold at stores that sell food, and more generally, the tool may be sold on the internet.

In one embodiment, the disclosed tool may be a tool for opening and dispensing soft packages comprising: at least two arms; a hinge that connects the two arms; a hole through one arm and a tubular prick through the other arm, wherein folding the two arms together via the hinge operates to put a cutting edge of the prick into the hole.

In another embodiment, disclosed may be tool for opening and dispensing soft packages comprising: at least two arms; a hollow prick; and, a hinge connecting the two arms. In one embodiment, the hinge includes an embedded spring to bias the arms apart. In another embodiment, the hollow prick features a pointed edge.

In use, the tool may be used for opening a soft goods package and dispensing the goods comprising the steps of: acquiring a tool comprised of a hollow prick, two arms connected by a hinge, wherein the hollow prick is disposed through one of the arms; while a clearance hole is disposed in the other arm; cleaning the tool; loading a condiment package onto the arm that features the hollow prick; ensuring that the face of the condiment package is in contact with the hollow prick; closing the tool by rotating one of the arms about the hinge toward the other arm so that the hollow prick presses into a face of the soft good package; ensuring the hollow prick has punctured the face of the condiment package; continuing to press the arms together so that the arms squeeze the soft good package while the prick presses a rear face of the packaging into the clearance hole; and exhausting a portion of the good via hollow prick towards a plate. In one mode the method further comprises comprising opening the tool and removing the condiment package from the tool.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed is a tool that can be used by children to puncture and dispense a condiment from a soft package. The tool features a tubular prick that is disposed through one arm and between two arms that are connected via a hinge. The tool allows a condiment to be dispensed via the tubular prick without tearing the package with one's hands and seeks to address problems associated with sanitation and food handling. The more specific details of the disclosed tool are described in connection with the figures.

Figure 1:
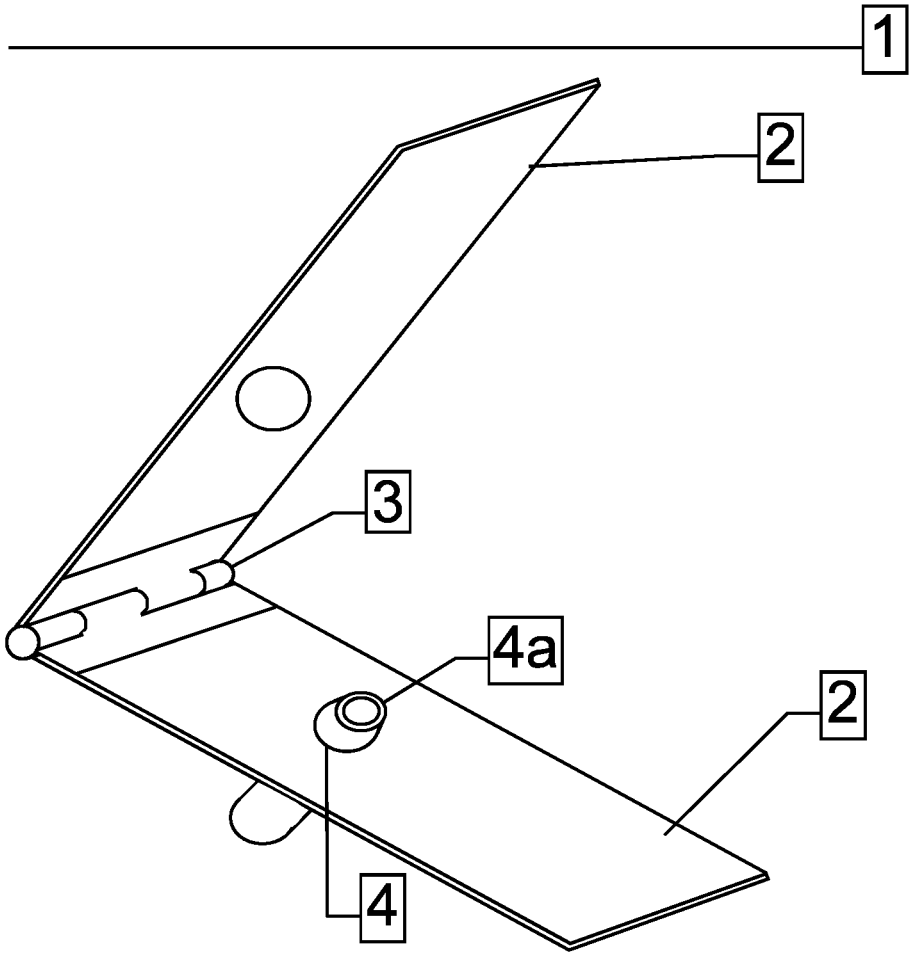
FIG. 1 is a perspective view of the tool.

As shown by the perspective view in FIG. 1 the tool 1 may consist of two chamfered rectangular arms 2 connected to a spring-loaded hinge 3. In some embodiments the tool 1 may feature a thin plastic hinge. A hollow prick 4 may preferably pass through one of the arms 2. In one embodiment the spring-loaded hinge 3 may be comprised of a cabinet hinge with a spring embedded in the hinge. The hinge 3 may be attached to the arms by rivet or adhesive or other means of attaching. In the embodiment shown in FIG. 1, the hinge 3 is attached by adhesive. The spring-loaded hinge may keep both arms 2 open at about a 45-degree angle. At this point, which is shown in FIG. 1, the tool would be described as open. When the tool is open, it is ready to be loaded with a condiment package or soft package.

Figure 2:
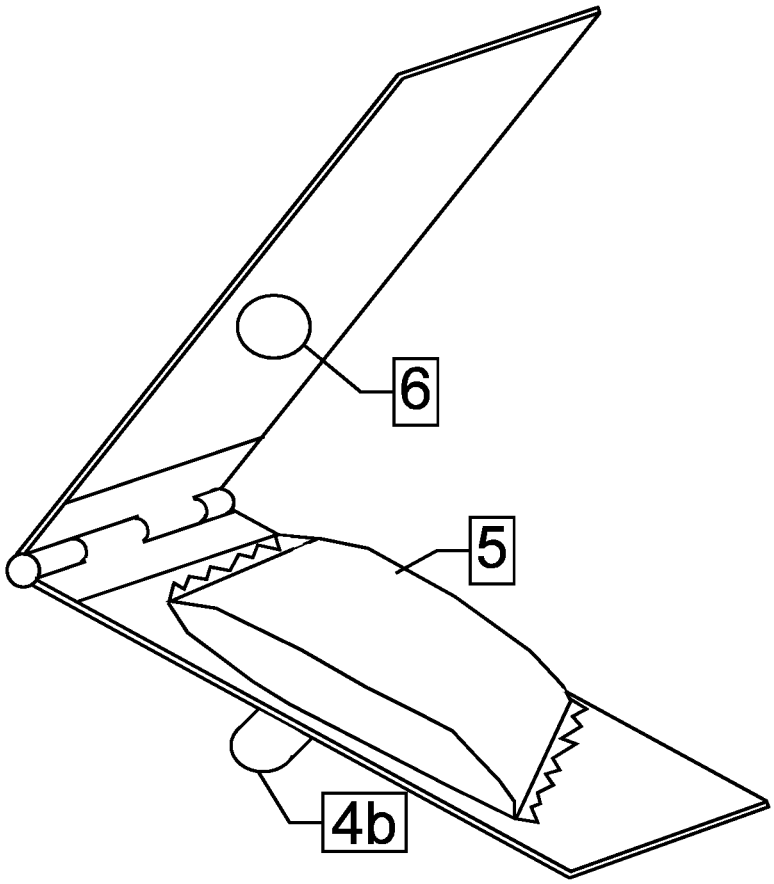
FIG. 2 is a perspective view of the tool.

The perspective view shown in FIG. 2 shows the tool 1 open and loaded. At this point one has taken a condiment package 5 and placed it on the lower arm 2 of the tool 1. The hollow prick 4 is in contact with, and perhaps protruding through, the face of the package 5. As shown the hollow prick 4 may go through the lower arm 2 from the top face to the bottom face of the lower arm 2. Portions of the prick 4 may protrude from each face of the lower arm 2. The portion that protrudes the upper face may serve as a condiment intake 4*a* while the portion that protrudes the lower face may serve as a condiment exhaust 4*b*. The lip of the intake portion may feature a cutting edge. The lip of the exhaust portion may be flat. Another feature of the tool 1 may be a clearance hole 6 on the upper arm 2 near the hinge 3. The hole 6 may provide clearance from the hollow prick 4 when the tool 1 is closed. The clearance prevents the hollow prick 3 from crashing into the upper arm 2 when the tool 1 is closed.

Figure 3:
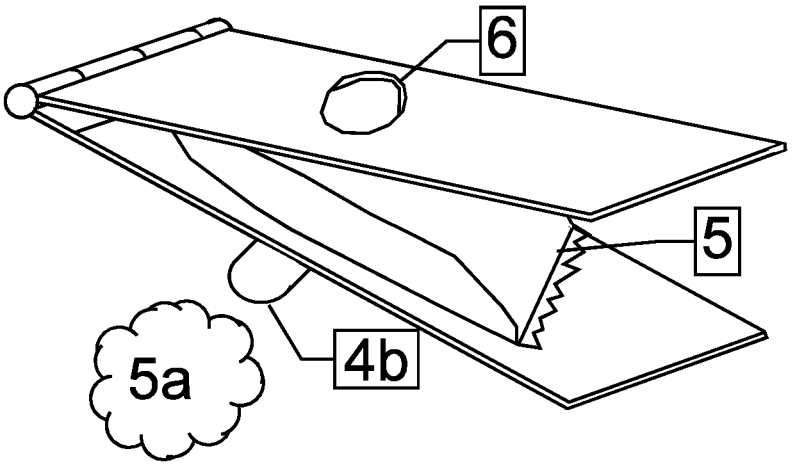
FIG. 3 is a perspective view of the tool.

As shown in FIG. 3 the tool 1 has been closed and the condiment package 5 is being dispensed. The intake 4*a* of the hollow prick 4 may have entered the clearance hole 6. To dispense the contents of the package 5 the two arms 2 must be pushed together in order to compress the package 5. When the tool 1 is compressed the hollow prick 4 punctures the package 5, and fluid 5*a* from the package 5 is compressed. The compression creates pressure in the package 5 which pushes fluid 5*a* out of the package through the hollow prick 4. The exhaust 4*b* of the hollow prick 4 may be oriented toward some food or a plate and fluid 5*a* may be dispensed therein.

Figure 4:
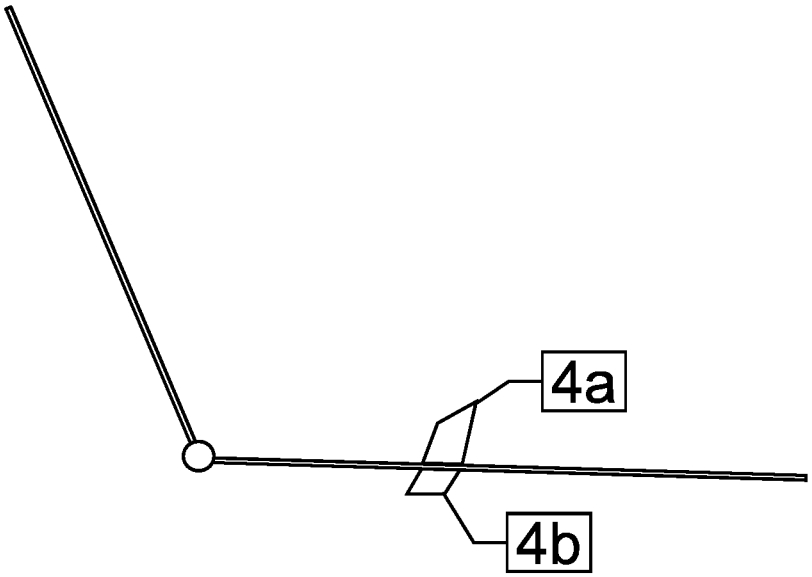
FIG. 4 is a side view of the tool.

FIG. 4 shows a side view of the opened tool 1. One feature that is shown is the hollow prick 4. The hollow prick 4 may feature a cutting edge to puncture soft packages 5. Clearly shown are the intake 4*a* and exhaust 4*b* portions of the hollow prick 4.

Figure 5:
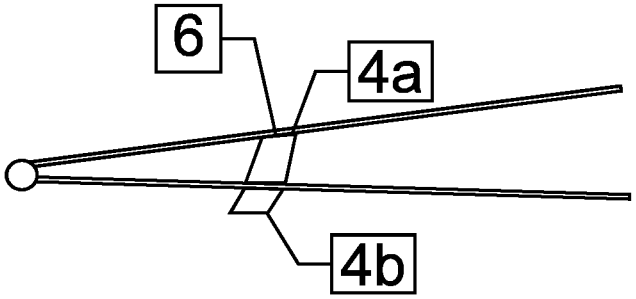
FIG. 5 is a side view of the tool.

For purposes of this document, when both arms 2 are touching or nearly touching as shown in FIG. 5, the tool 1 is described as closed. FIG. 5 shows the tool 1 closed. If the tool 1 is closed when loaded a condiment 5 may be dispensed. When closed the intake 4*a* portion of the hollow prick 4 may be inside or nearly inside the clearance hole 6.

The tool 1 may also incorporate another thin, flexible, plastic hinge that is bent to a 45-degree angle when the tool 1 is open. The plastic hinge may attach, either by rivet or adhesive, to the arm and the spring-loaded hinge 3. The flexibility of the thin plastic hinge may allow for both arms 2 to touch, making a 0-degree angle between the arms allow the tool 1 to be closed.

Figure 6:
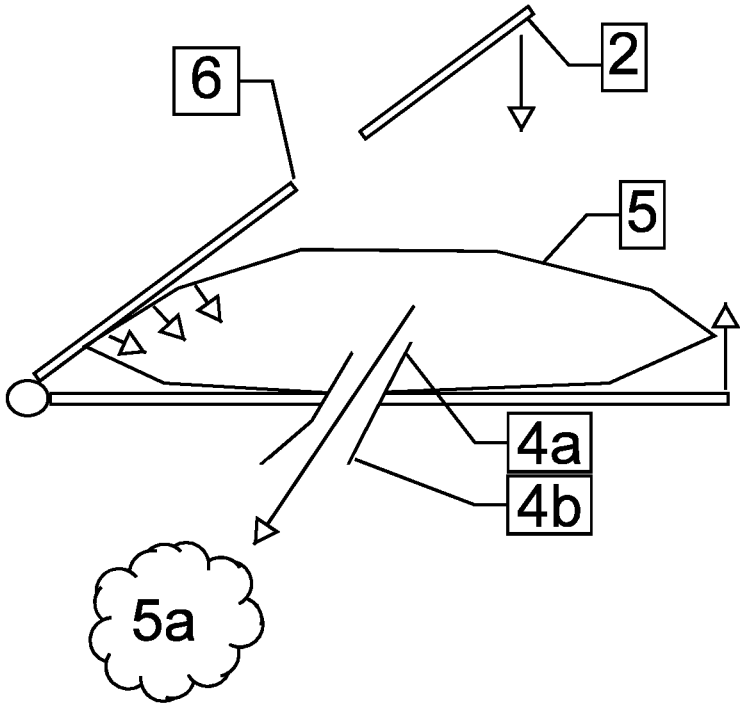
FIG. 6 is a cross sectional view of the tool.

FIG. 6 shows a cross sectional view of the tool 1 in use. As shown, a condiment package 5 has been loaded onto the lower arm 2 and the hollow prick 4 has punctured the face of the condiment package 5. The arms 2 are being compressed together creating internal pressure in the package. Due to this internal pressure, fluids 5*a* are flowing into the intake 4*a* and out of the exhaust 4*b* of the tubular prick 4. In whatever direction the exhaust 4*b* is pointed in, fluids 5*a* are dispensed. Also shown is the clearance hole 6 which is correspondent to the hollow prick 4. As the upper arm 2 gets closer and closer to the lower arm 2 the hollow prick 4 will eventually enter the clearance hole 6.

Figure 7:
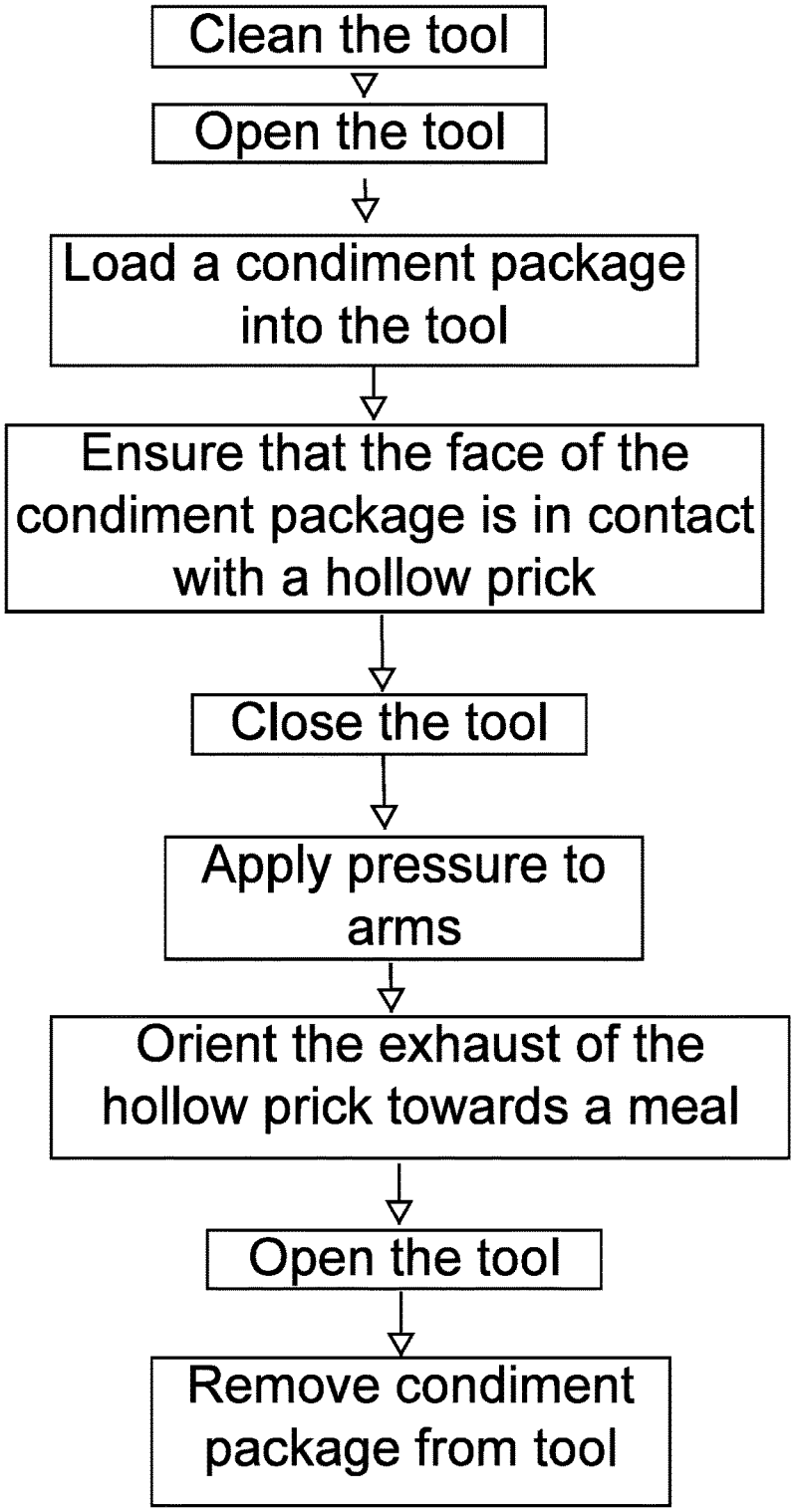
FIG. 7 is a flow chart describing the steps involved with using the tool.

To use the tool on may follow the steps outlined in the flow chart shown in FIG. 7. One may start by cleaning the tool 1 if it is not already clean. The tool 1 may be cleaned like any other utensil or cooking tool. Then one may open the tool 1 as shown in FIGS. 1 and 4. Then a condiment package 5 may be loaded onto the lower arm 2 of the tool 1 as shown in FIG. 2. One may puncture the face of the condiment 5 with the hollow prick 4 or at least ensure the hollow prick 4 is in contact with the face of the condiment package 5. Now the tool 1 must be closed and compressed. The tool 1 may be closed by rotating the upper arm 2 around the spring-loaded hinge 3 so that the upper arm 2 is in contact with the face of the condiment package 5. At this point both faces of the condiment package 5 are in contact with both arms 2 and the hollow prick 4. Then the arms 2 may be pushed together or compressed. This compression may ensure that the prick 4 protrudes the face of the condiment package 5 and create internal pressure inside the condiment package 5. The internal pressure should push fluids 5*a* through the package 5, intake 4*a*, and exhaust 4*b*. Fluid 5*a* may be dispensed in the direction that the exhaust 4*b* is oriented, ideally towards a plate or food.

Figure 8:
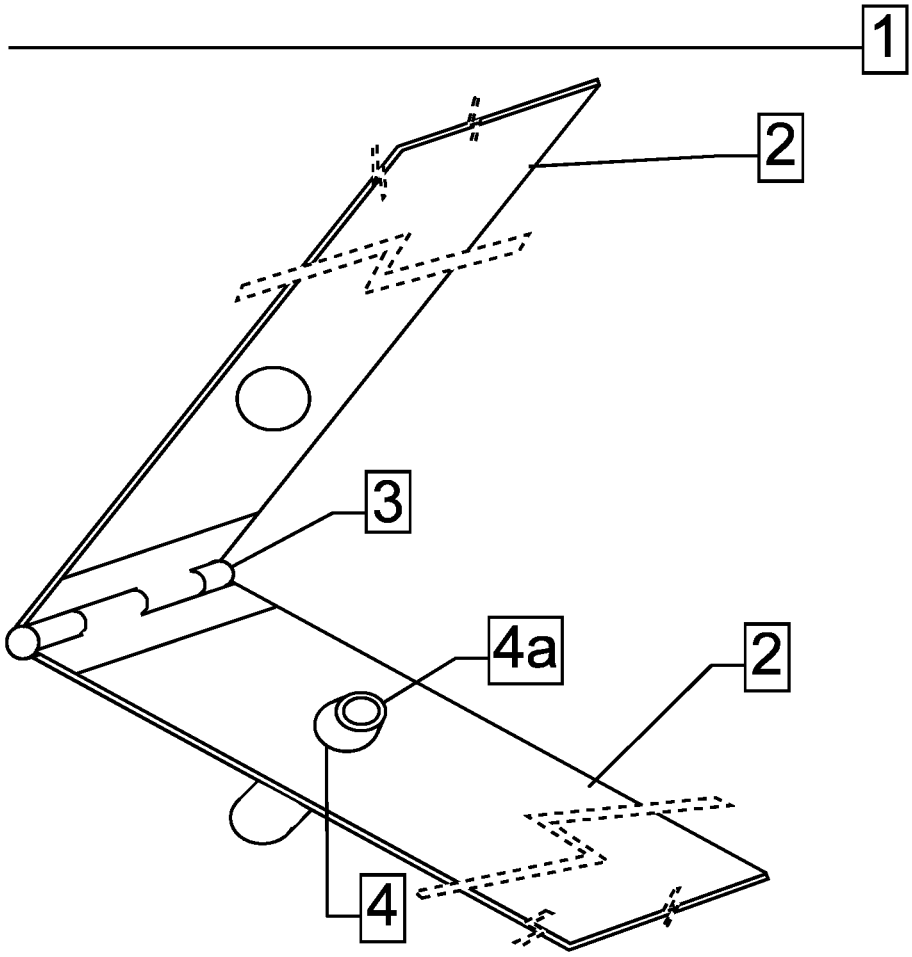
FIG. 8 is a perspective view of an alternate embodiment of the tool.

The size and shape of tool 1 components may be varied to increase the functionality of the tool 1. FIG. 8 shows a tool 1 of variable arm 2 sizes. The arms 2 may vary in size and shape to make the tool 1 easier for children to handle. Varied tool 1 component sizes may be used to make the tool 1 mirror the size of dimensionally diverse condiment packages 5. Varied arm 2 dimensions, and hollow prick 4 placement may be configured to optimize the mechanical advantage of the tool 1. The thickness of the arms 2 may be adjusted to better attach the prick 4 to the arm 2 or to prevent the hollow prick 4 from puncturing both faces of the condiment package 5. Also worth noting is that the geometry of the arms 2 is not limited to rectangles. The arms 2 may feature chamfered or filleted edges for manufacturing purposes or to the increase accessibility and visibility of the condiment package 5 when it is sandwiched between the arms 2.

Figure 9:
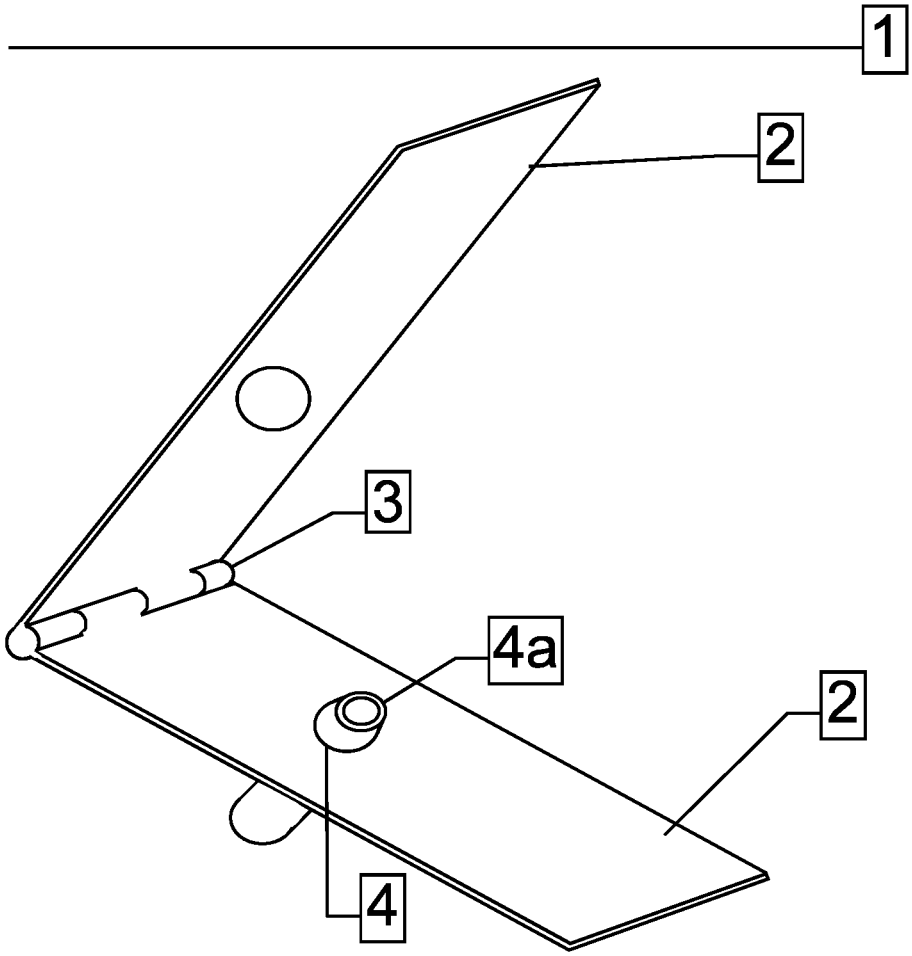
FIG. 9 is a perspective view of an alternate embodiment of the tool.
Figure 10:
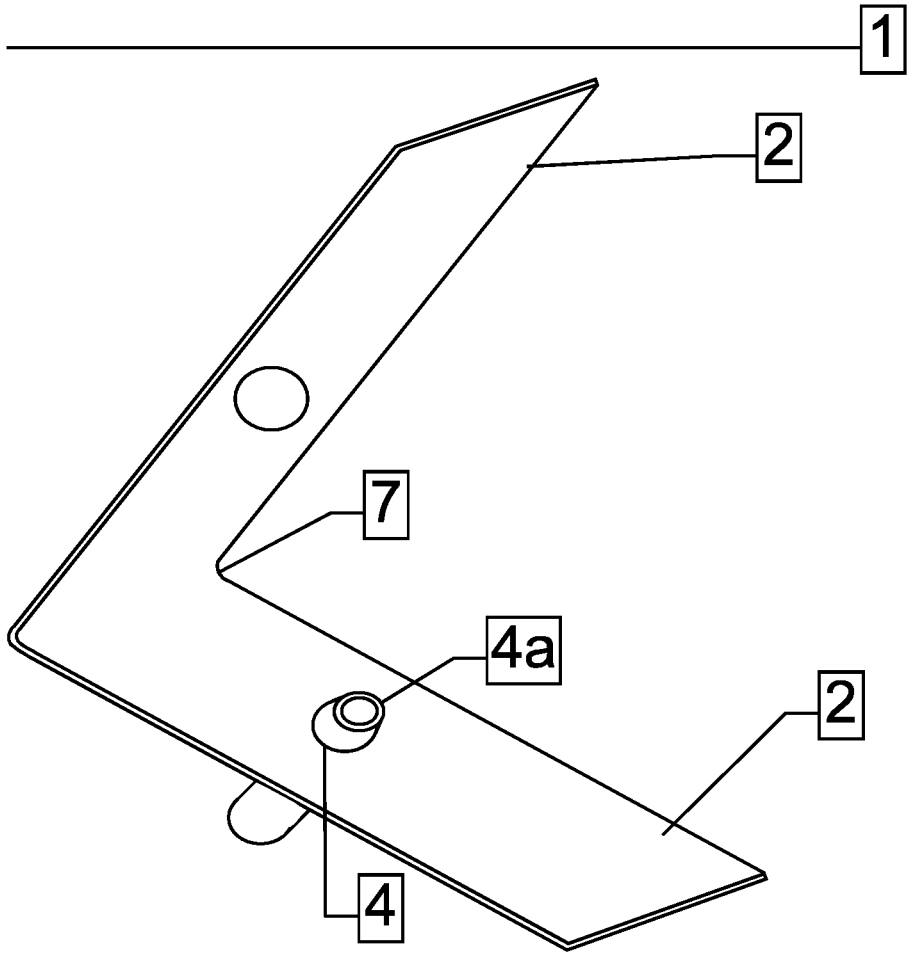
FIG. 10 is a perspective view of an alternate embodiment of the tool.

FIGS. 9 and 10 speak to alternative embodiments of the tool 1. FIG. 9 shows an alternate embodiment in which the spring-loaded hinge 3 is incorporated into the arms 2 seamlessly. FIG. 10 an embodiment in which a plastic hinge 7 has replaced the spring-loaded hinge 3. The plastic hinge 7 may be comprised of a piece of embedded memory plastic pre-bent to an acute angle and configured to reach the angle zero when adequate pressure is applied to the arms 2.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

PAPER "SEQUENCE LISTING"

Not applicable.

What is claimed is:

1. A tool for opening and dispensing soft, condiment packages comprising:

at least two arms, namely a first arm with a tubular prick that is fixedly connected to and passed through the first arm such that a first lip with a cutting edge of the tubular prick continuously protrudes from a first face of the first arm to define a condiment intake while a flat, second lip of the tubular prick continuously protrudes from a second face of the first arm to define a condiment exhaust a second arm with a clearance hole in a face of the second arm such that said cutting edge is provided into said clearance hole without contacting the second arm whenever the first face of the first arm interfaces with the face of the second arm;

a hinge connecting the two arms such that closing the hinge results in an interface of the first face of the first arm and the face of the second arm;

a spring embedded in the hinge and maintaining the two arms in an approximately forty-five degree relationship between the first face of the first arm and the face of the second arm whenever a force for closing the hinge is absent;

a condiment package disposed between the first face of the first arm and the face of the second arm such that the condiment intake is provided within the condiment package, wherein a condiment is intook and exhausted respectively through the condiment intake and condiment exhaust when the force is present and the first face of the first arm and the face of the second arm are pressed against the condiment package; and, wherein a length of the first arm and a length of the second arm are both larger than a length or width of the condiment package.

2. A tool for opening and dispensing soft condiment packages comprising:

at least two arms;

a fixed hollow prick passing through one arm;

a spring loaded hinge connecting the two arms and maintaining the two arms in an approximately forty-five degree relationship relative to one another whenever a force for closing the hinge is absent; and, a spring embedded within the hinge that, whenever the force is present, is compressed such that the two arms are both interfaced with a surface of the soft condiment package.

3. The tool of claim 2 wherein the hollow prick features a pointed edge.

4. The tool of claim 3 further comprising a clearance hole.

5. The tool of claim 4 wherein the clearance hole passes through one arm.

6. The tool of claim 5 wherein the clearance hole and the hollow prick are on opposite arms in correspondent positions.

7. A method of opening and dispensing a soft goods package comprising:

acquiring a tool comprised of a hollow prick, two arms connected by a spring loaded hinge, and the hollow prick that passes through one of the arms;

cleaning the tool;

using a spring force of the spring loaded hinge to open the tool to an angle of approximately forty-five degrees between the two arms;

loading a condiment package onto one of the arms that features the hollow prick;

ensuring that a face of the condiment package is in contact with the hollow prick;

closing the tool by rotating one of the arms about the hinge until the condiment package is compressed between the two arms and the hollow prick has punctured the face of the condiment package;

ensuring the hollow prick has punctured the face of the condiment package;

orienting an exhaust portion of the hollow prick towards a plate of food;

further closing the tool by rotating one of the arms about the hinge such that pressure is applied to a midsection of the condiment package until a portion of the condiment is exhausted from the exhaust portion of the hollow prick onto the food; and, removing the condiment package from between the two arms and disposing the package.

* * * * *